US005893218A

United States Patent [19]

Hunter et al.

[11] Patent Number: 5,893,218

[45] Date of Patent: Apr. 13, 1999

[54] SEED DRYER WITH AUTOMATIC CONTROL OF TEMPERATURE AIR FLOW DIRECTION AND RATE

[75] Inventors: James L. Hunter, Ankeny; Cyrille Precetti, Des Moines; Paul Chicoine, Johnston, all of Iowa

[73] Assignee: Pioneer Hi-Bred International, Inc., Johnston, Iowa

[21] Appl. No.: 08/842,621

[22] Filed: Apr. 15, 1997

[51] Int. Cl.[6] ..... F26B 3/00

[52] U.S. Cl. ..... 34/492; 34/494; 34/496; 34/497; 34/68; 34/168; 34/181

[58] Field of Search ..... 34/65, 68, 86, 34/168, 174, 181, 216, 487, 492, 493, 494, 495, 496, 497; 236/49.3

[56] References Cited

U.S. PATENT DOCUMENTS 3,629,954 12/1971 Lavalier ..... 34/174 X
4,249,891 2/1981 Noyes et al. ..... 34/171 X
4,404,756 9/1983 Noyes ..... 34/65
4,549,362 10/1985 Haried ..... 34/467
4,599,809 7/1986 Parkes ..... 34/491 X

*Primary Examiner*—Henry A. Bennett
*Assistant Examiner*—Steve Gravini
*Attorney, Agent, or Firm*—Zarley, McKee, Thomte, Voorhees & Sease

[57] ABSTRACT

An automatically controlled seed dryer of the present invention is adapted to efficiently and precisely dry seed by automatically controlling the temperatures directions and air flow rate; of air flow through the seed within the bin. The invention includes an upper plenum for supplying a source of hot airs a lower plenum for supplying a source of ambient air, and a mixing plenum for mixing various proportions of hot and ambient air from the upper and lower plenums. The mixing plenum has upper and lower supply doors formed between the mixing plenum and the bin for supplying the mixed air to the bin either above or below the seed. Upper and lower exhaust doors are formed in the bin above and below the seed such that by controlling the operation of the supply and exhaust doors, the direction and air flow rate of the mixed air through the seed can be precisely controlled by an electronic controller. A plurality of linear actuators control the operation of the doors.

30 Claims, 10 Drawing Sheets

SEED DRYER WITH AUTOMATIC CONTROL OF TEMPERATURE AIR FLOW DIRECTION AND RATE

BACKGROUND OF THE INVENTION

1. Field of the Invention

The present invention relates to seed dryers. More particularly though not exclusively, the present invention relates to an apparatus and method for controlling the temperature and air flow direction of a seed dryer.

2. Problems in the Art

In the agricultural industry seed is frequently harvested at moisture levels exceeding that which would permit safe and a long term storage. The crops are harvested while the moisture content is high in order to help prevent reductions in quality of the seeds from things such as insects, disease, or exposure to adverse weather. This high moisture harvesting of seed is only possible when combined with artificial drying to bring the seeds down to an acceptable moisture level. The drying process must occur under strictly controlled conditions in order to maximize the quality of a seed product. Factors such as the rate and the temperature at which seed dries has a large effect upon the seeds' germination and storability.

Typical prior art seed dryers are usually comprised of single pass dryers with air supplied from a common plenum or two-pass reversible dryers. In a single pass dryer, all of the bins will receive air having the same temperature. With a two-pass dryer, the bins can receive air having only one of two possible temperatures and one flow rate. Typically, hot air from the upper plenum is forced, in a first pass, through the corn from top to bottom, feeding the lower plenum with lower temperature and higher relative humidity air, then in the second pass, air is forced through another bin from bottom to top, then exhausted to the outside. High moisture corn is first dried with second pass air, then as moisture lowers, it is dried with first pass air. Changing bins from second pass air to first pass air is called reversal. Two-pass dryers require careful management to insure that roughly equal numbers of bins receive first and second pass air in order to maintain a balanced static pressure in the plenums. Also, reversal of the air flow through the bins can occur only once during the drying process. In either single pass or two-pass dryers, the precise control of the drying process is not possible. FIG. 1 shows a typical prior art two-pass dryer (described below).

Other prior art drying systems regulate the air temperature of individual bins by supplying drying air from individual burners (or heating coils) and fans for each bin. This prior art system permits individual bin temperature regulation, but with typical large drying installations having a plurality of bins, the cost of acquiring and maintaining all of the necessary individual burners and fans is prohibitive.

The concept of mixing high and low temperature streams of air is used in the heating and cooling of buildings. It is also known to control the temperature of water from a faucet by mixing various proportions of hot and cold water.

3. Features of the Invention

A general feature of the present invention is the provision of a method and apparatus for drying seed which overcomes problems found in the prior art.

A further feature of the present invention is the provision of a method and apparatus for drying seed which permits the complete control of the drying process on an individual bin basis.

A further feature of the present invention is the provision of a method and apparatus for drying seed which uses an electronic controller to control the precise temperature and direction of air flow through the seed to be dried.

A further feature, objects and advantages of the present invention includes:

An apparatus and method for drying seed which uses a mixing plenum to selectively mix certain amounts of relatively hot and cold air to provide air having a desired temperature for drying the seed.

An apparatus and method for drying seed which uses an upper and lower door to blow air either above or below the seed to be dried and adjustable exhaust ports located above and below the seed to be dried in order to selectively control the direction of air flow through the seed.

An apparatus and method for drying seed which controls the airflow direction through the seed to maintain consistency within a bin.

An apparatus and method for drying seed which uses an electronic controller to control the operation of various doors to precisely mix the hot and cold air as well as control the air flow direction through the seed.

An apparatus and method for drying seed which uses a programmable logic controller to control the operation of the dryer.

An apparatus and method for drying seed which includes temperature sensors to sense the temperature of the air blown into the bin.

An apparatus and method for drying seed which measures the static pressure above and below the seed in the bin to control the air flow through the bin.

An apparatus and method for drying seed which optimizes dryer capacity, energy efficiency, and seed quality.

An apparatus and method for drying seed which uses a plurality of drying bins which is capable of precisely controlling the temperature of air entering each bin without the need for individual fans and burners for each individual bin.

An apparatus and method for drying seed which uses fuzzy logic to control the temperature and flow of air through the bin.

These as well as other objects, features and advantages of the present invention will become apparent from the following specification and claims.

SUMMARY OF THE INVENTION

The seed dryer of the present invention is used to dry seeds while automatically controlling the temperature, direction, and velocity of air through the seed dryer. The invention is comprised of relatively hot and cold sources of air which are mixed in a mixing plenum resulting in a mixture of air having a desired temperature. The mixture of air is blown through the seeds to be dried in a seed bin. A series of supply and exhaust doors disposed above and below the seeds within the bin are controlled to provide air flow in a desired direction through the seed. An electronic controller controls the operation of the seed dryer by controlling the mixture of air therefore the temperature of the air, as well as the series of doors for controlling the direction, and air flow rate through the seed.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
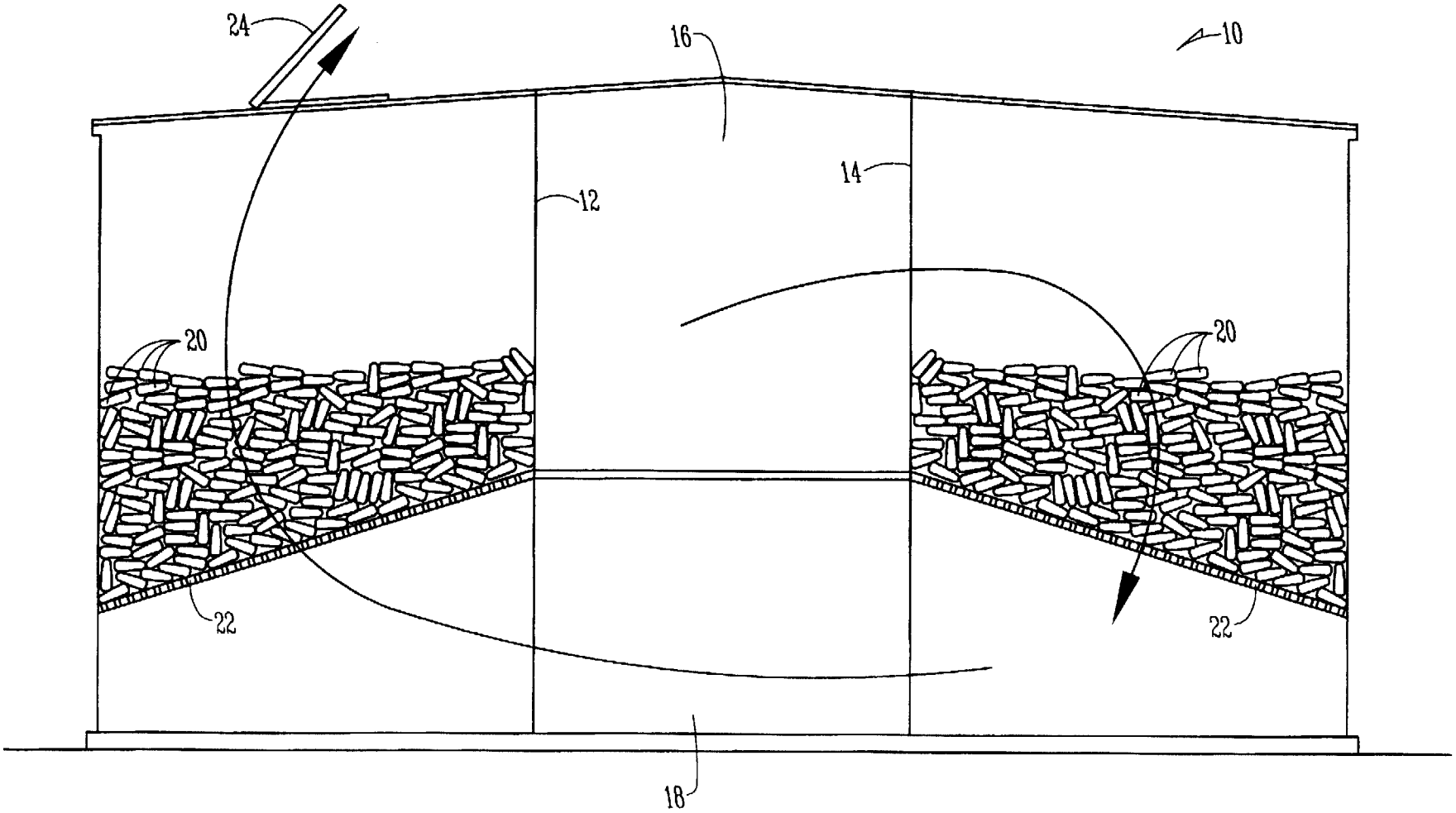
Fig. 1 (Prior Art)
FIG. 1 shows a prior art two-pass dryer.

FIG. 1 shows a typical prior art two-pass dryer 10. A pair of opposing bins 12 and 14 are disposed outside of an upper plenum 16 and a lower plenum 18. The upper plenum 16 supplies a source of hot air (for example, 110° F.) while the lower plenum 18 supplies a source of cooler air (for example, 90° F.). Within each of the bins 12 and 14 is a volume of ear corn 20 which is stacked above an air permeable grate 22. In the example shown in FIG. 1, the corn within the bin 12 has a higher moisture content than the corn in the bin 14. With a two-pass seed corn dryer, the hotter air from plenum 16 is introduced into bin 14 and flows down through the corn 20 as shown by the arrow. The air passes through the grate 22 and into the lower plenum 18. The air in the lower plenum 18 is now a cooler temperature than the air in the upper plenum 16. Air from the lower plenum 18 is then introduced into the bin 12 and passes through the grate 22, through the corn 20 and out through a door 24, as shown by the arrow. By using the two-pass seed corn dryer, air with two possible temperatures (in this example, 110° F. or 90° F.) can be blown through the seed corn 20 with a direction depending on whether the air is coming from the upper plenum 16 or the lower plenum 18.

Figure 2:
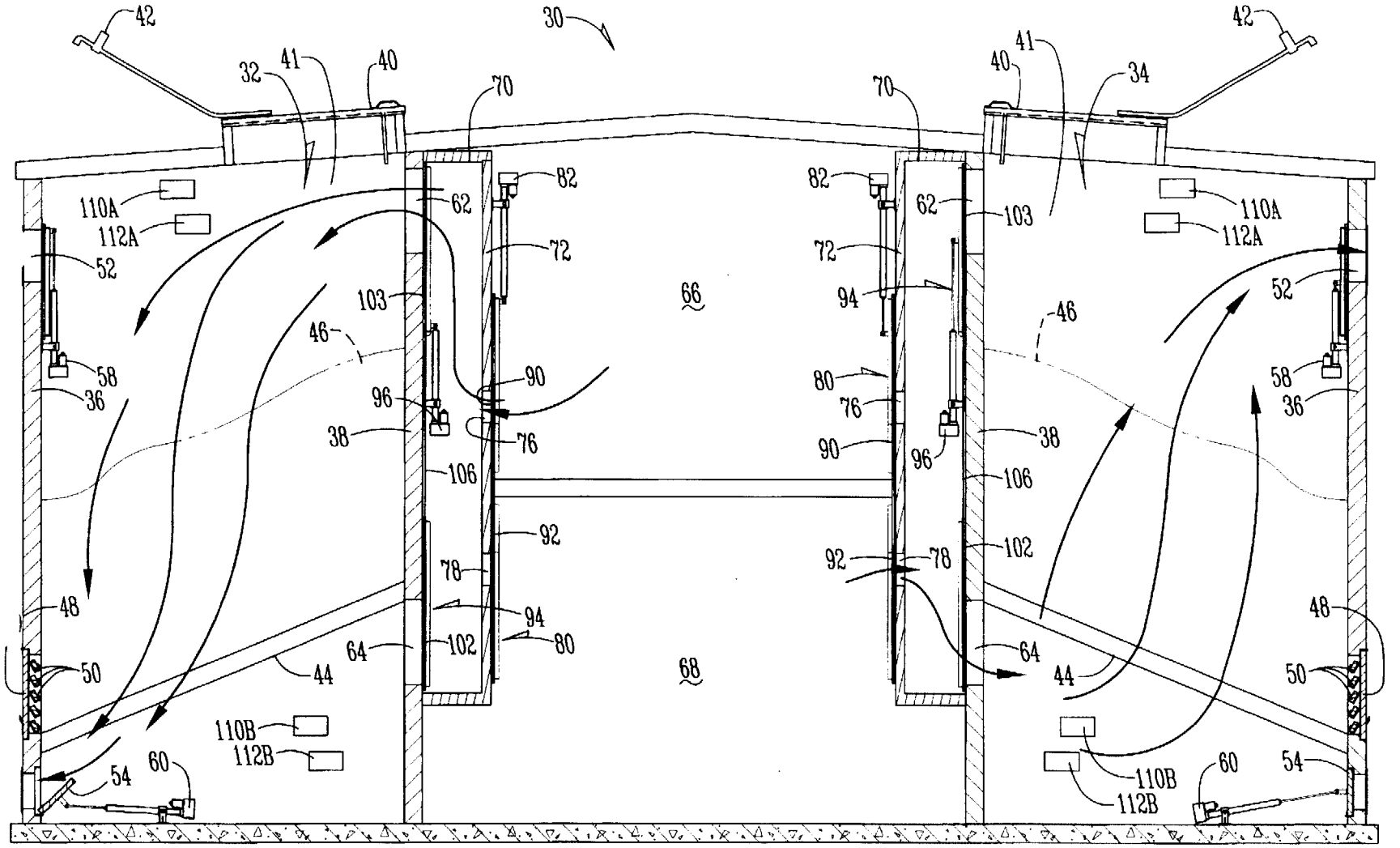
FIGS. 2 and 2A show side views of opposing dryer bins of the present invention.
Figure 2A:
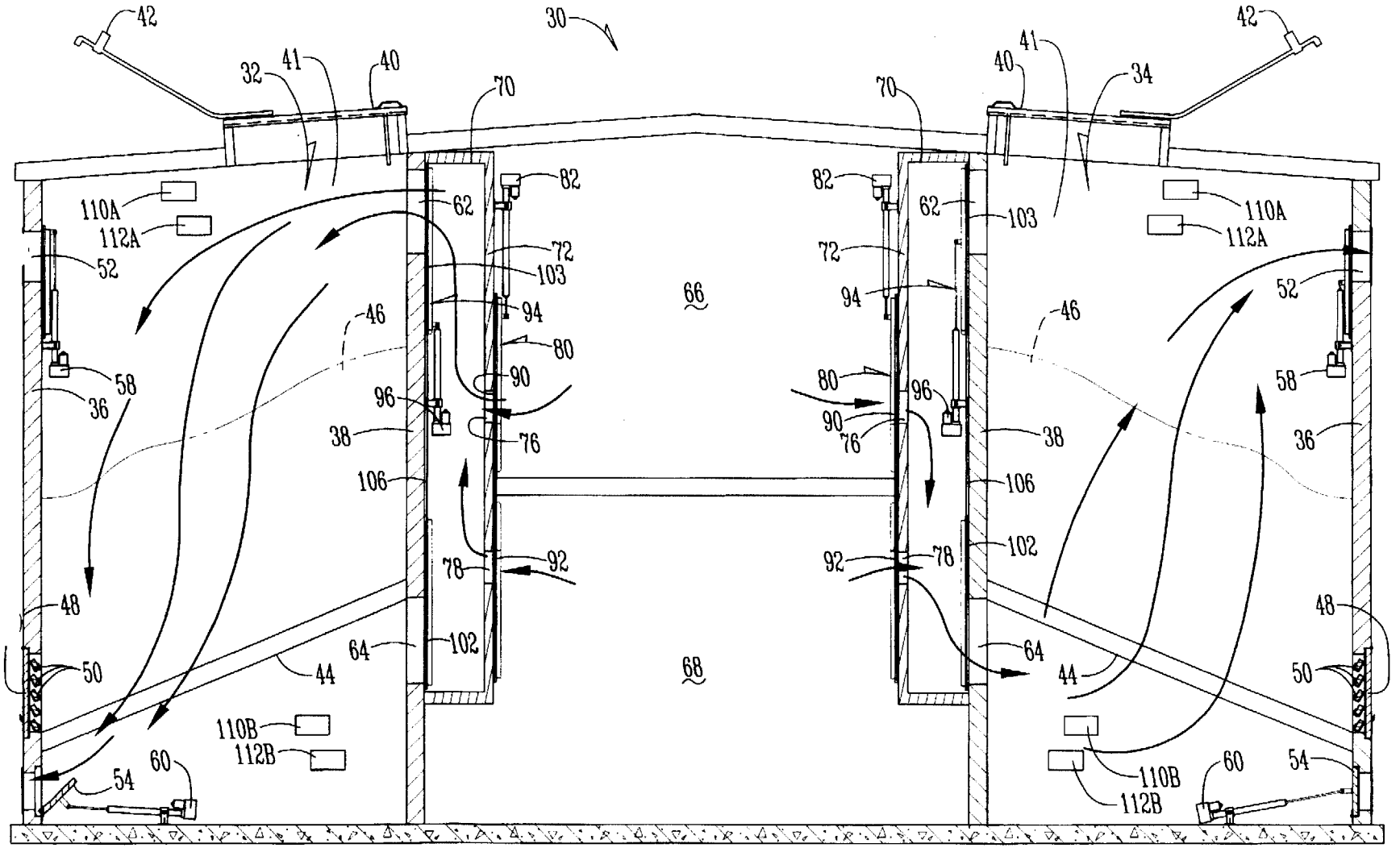

FIGS. 2 and 2A show sectional views of a seed dryer 30 of the present invention. As shown, the preferred embodiment of the present invention uses opposing seed bins 32 and 34 which are mirror images of each other. Each bin 32 and 34 includes an outside wall 36, an inside wall 38, and opposing side walls (not shown) forming the bin. Formed on the top of each of the bins 32 and 34 is a door 40 including counterweights 42. The doors 40 are used to load the bins 32 and 34 with seed such as seed corn. Disposed within the bins 32 and 34 is a slanted air permeable floor 44. The floors 44 are perforated or grated such that ear corn will not fall through the floors 44 but air can easily pass through. During operation of the dryer 30, seed such as ear corn is loaded into each of the bins 32 and 34 up to the level marked by line 46 (approximately 8 feet deep). Formed on the outside wall 36, adjacent to the floor 44, is an unloading door 48 comprised of a flat solid door and a number of 2×4's 50 held in place by appropriately shaped brackets. Also formed on the outside walls 36 is an upper exhaust door 52 and a lower exhaust door 54. Each of the doors 52 and 54 are controlled by linear actuators 58 and 60 (described below). The exhaust doors 52 and 54 having metal grates attached over the openings to prevent birds or other animals from entering the bins.

Formed on each of the inside walls 38 is an upper supply door 62 and a lower supply door 64. The upper doors 52 and 62 are each positioned above the corn loaded into the bin while the lower doors 54 and 64 are each disposed below the floor 44. The direction of the air flow through the corn can be controlled by controlling the upper and lower inside and outside doors (described below). The pressure drop across the seed in the bin can also be controlled by controlling the amount that the various doors are opened to control the size of the openings in the doors.

Formed between the bins 32 and 34 are an upper plenum 66 and a lower plenum 68. The upper plenum 66 contains a source of relatively hot air while the lower plenum 68 provides an independent source of relatively cooler air. Pressure transducers (not shown) are installed within the plenums 66 and 68 to measure the difference in pressure between the plenums and the outside air. The output from the transducers is fed back to variable speed fans (not shown) which control the pressure in the upper and lower plenums 66 and 68. Preferably, a two inch pressure differential is maintained between the plenums and the outside air. Disposed adjacent to each of the inside walls 38 is a mixing plenum 70 described in detail below. By controlling the operation of the mixing plenum 70 and the doors 52, 54, 62 and 64, the temperature and direction of air flow through the corn can be controlled. The temperatures of the air in the upper and lower plenums 66 and 68 can vary, but preferably are about 110° F. and 90° F., respectively.

Figure 3:
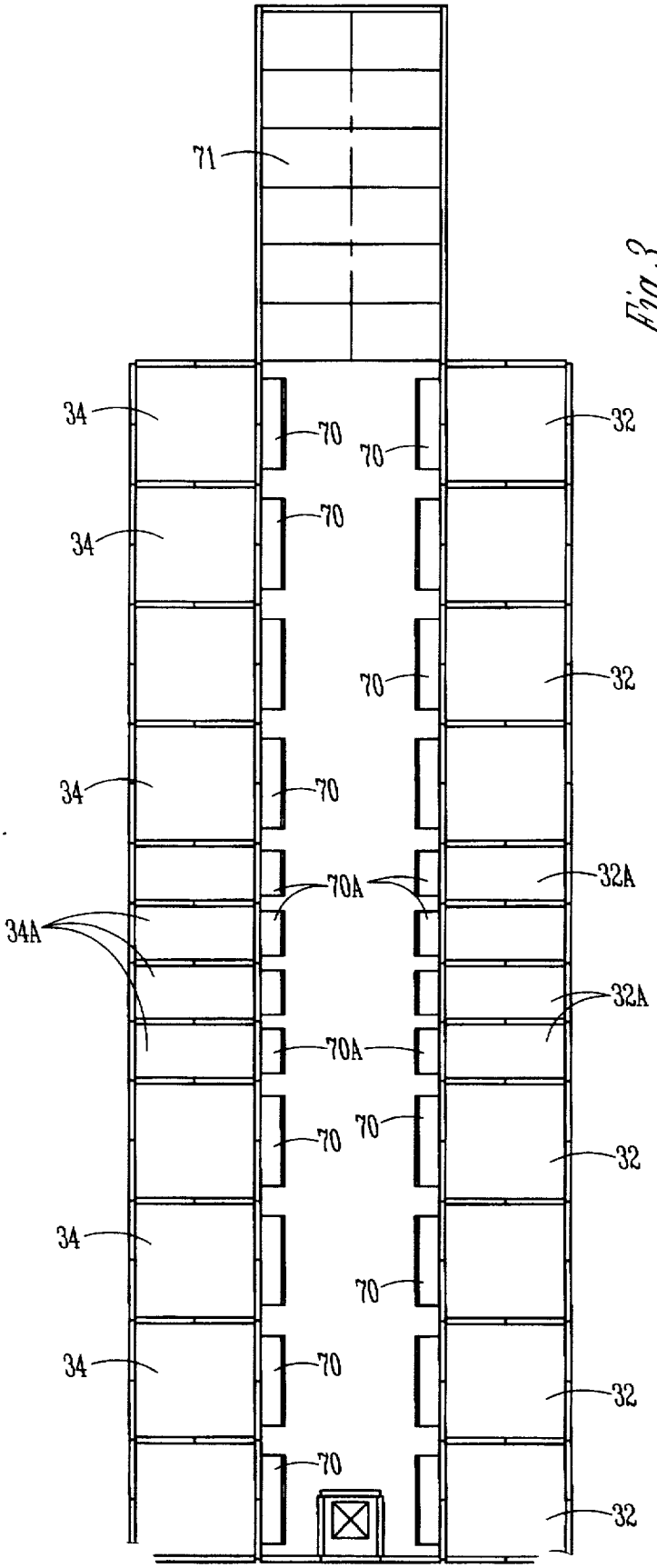
FIG. 3 shows a plan view of a plurality of dryer bins of the present invention.

FIG. 3 shows a plan view of a typical layout of the present invention. As shown, a plurality of opposing bins 32 and 34 are disposed along an elongated upper and lower plenum. Also shown in FIG. 3 are a number of bins 32A and 34A which are substantially identical to the bins 32 and 34 except for the size of the bins. Each of the bins 32A and 34A are adjacent to a mixing plenum 70A which are substantially the same as the mixing plenums 70. By having bins of differing volumes, the seed dryers are more flexible and efficient. Preferably, the bins 32 and 34 hold 250 bushels while the bins 32A and 34A hold 125 bushels. FIG. 3 also shows a burner cab 71 which houses burners and fans (not shown) for supplying heated or ambient air to the upper and lower plenums 66 and 68.

FIGS. 4–9 show enlarged sectional views of the mixing plenum 70 shown in FIGS. 2 and 2A disposed adjacent to the bin 34. Again, the mixing plenum disposed adjacent to the bin 32 is a mirror image of mixing plenum 70 shown in FIGS. 4–9. As shown, the mixing plenum 70 has a volume defined by a side wall 72, top and bottom walls 74 and the inside wall 38 of the bin 34. The mixing plenum 70 is in communication with the upper plenum 66 via an upper plenum opening 76 and is in communication with the lower plenum 68 via lower plenum opening 78. The mixing plenum 70 is in communication with the bin 34 via upper supply door 62 and lower supply door 64 described above.

Precisely controlling the amount of air entering the mixing plenum 70 from the plenums 66 and 68 allows the user to precisely control the temperature of air within the mixing plenum 70. As shown, a slide gate assembly 80 is coupled to the wall 72. The slide gate assembly 80 includes a linear actuator 82, two opposing plastic low friction channels 84, reinforcing angle iron 86, and a flat metal sheet 88 comprised of a material such as sheet metal slidable disposed between the opposing channels 84. A pair of holes 90 and 92 are formed in the sheet 88 and allow air to pass through the holes 76 or 78, respectively, depending on the position of the sheet 88 relative to the holes 76 or 78. By controlling the linear actuator 82, the flow rate and temperature of air in the mixing plenum 70 can be precisely controlled.

Figure 12:
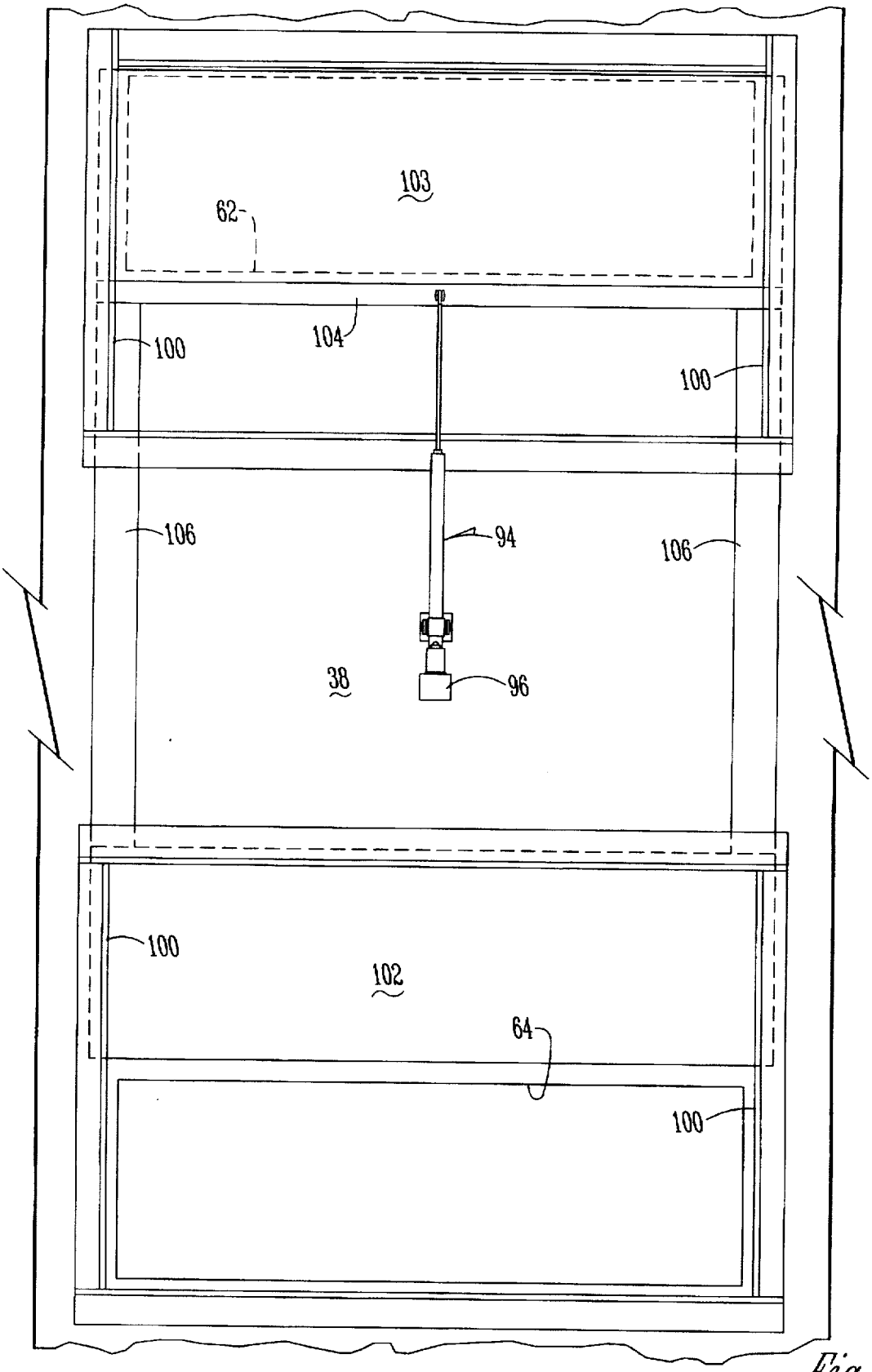
FIG. 12 is a front view of the inside wall shown in FIG. 4.

Coupled to the inside wall 38 of the bin 34 is a second slide gate assembly 94. FIG. 12 shows a front view of the inside wall 38 of the bin 34. The second slide gate assembly 94 is comprised of a linear actuator 96, two sets of opposing low friction plastic channels 98, two sets of reinforcing angle iron 100, and two flat metal sheets 102 and 103 slidably positioned between the two opposing channels 98 proximate each of the upper and lower supply doors 62 and 64. The actuator 96 is coupled to a cross piece 104. The cross piece 104 is coupled to the sheet 103 and to a linkage 106. The linkage 106 is coupled to the sheet 102. By controlling the linear actuator 96, the upper and lower supply doors 62 and 64 can be opened and closed by sliding the sheets 102 and 103 up or down. Since the two flat metal sheets 102 and 103 are coupled together, when one door 62 or 64 is closed, the other door will be opened. In this ways the air leaving the mixing plenum 70 can be controlled and directed through the upper door 62 or the lower door 64. Alternatively, two slide gates could replace the slide gate assembly 94 to independently control the doors 62 and 64. Using two independent slide gates instead of one allows the temperature and pressure to be better controlled, although at a higher cost.

Within each bin 32 and 34 are two identical sets of slide gate assemblies 80 and 94 disposed side-by-side. In the smaller bins 32A and 34A, only one set of each of the slide gate assemblies 80 and 94 are needed since the bins 32A and 34A are smaller.

Figure 4:
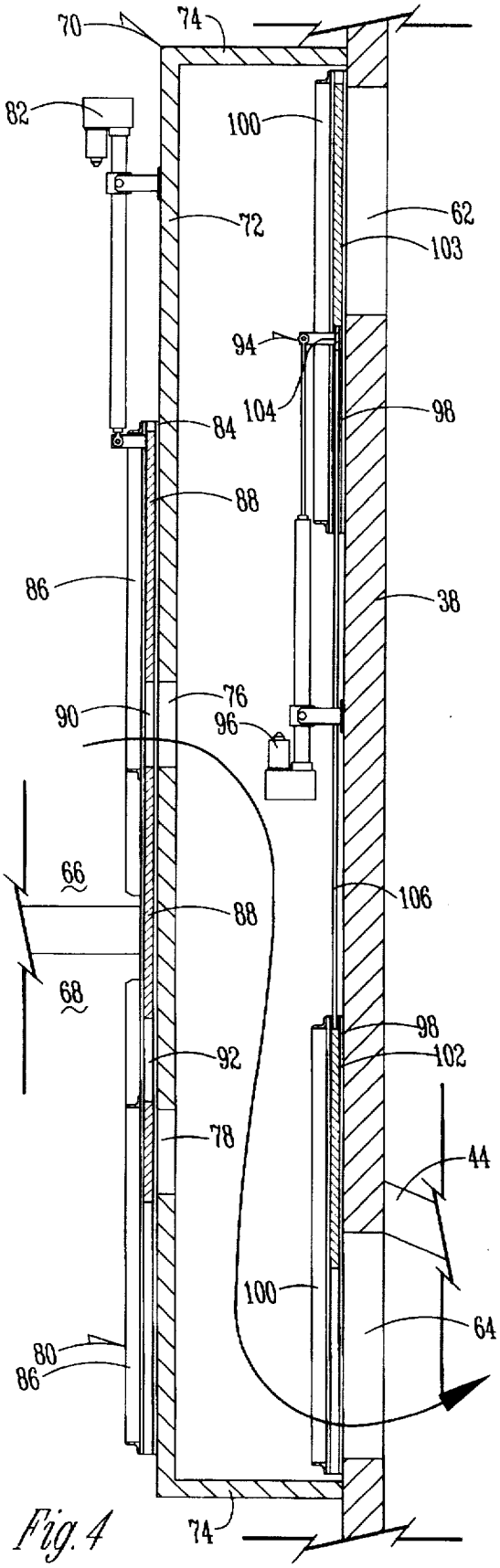
FIGS. 4–11 show sectional views of the mixing plenum operating under a number of possible configurations.

Again, FIGS. 4–9 show the mixing plenum 70 in several possible configurations. In FIG. 4, the mixing plenum 70 is controlled so that air will flow upward through the corn in the bin 34 and will come entirely from the upper plenum 66. As shown, the slide gate assembly 80 is controlled such that the upper hole 90 formed in the sheet 88 is aligned with the upper plenum opening 76 while the lower hole 92 is not aligned with the lower plenum opening 78 allowing air from the upper plenum to enter the mixing plenum 70 but blocking air from the lower plenum 68 from entering the mixing plenum 70. This configuration results in hot air blown upward through the seed in the bin 34.

Figure 5:
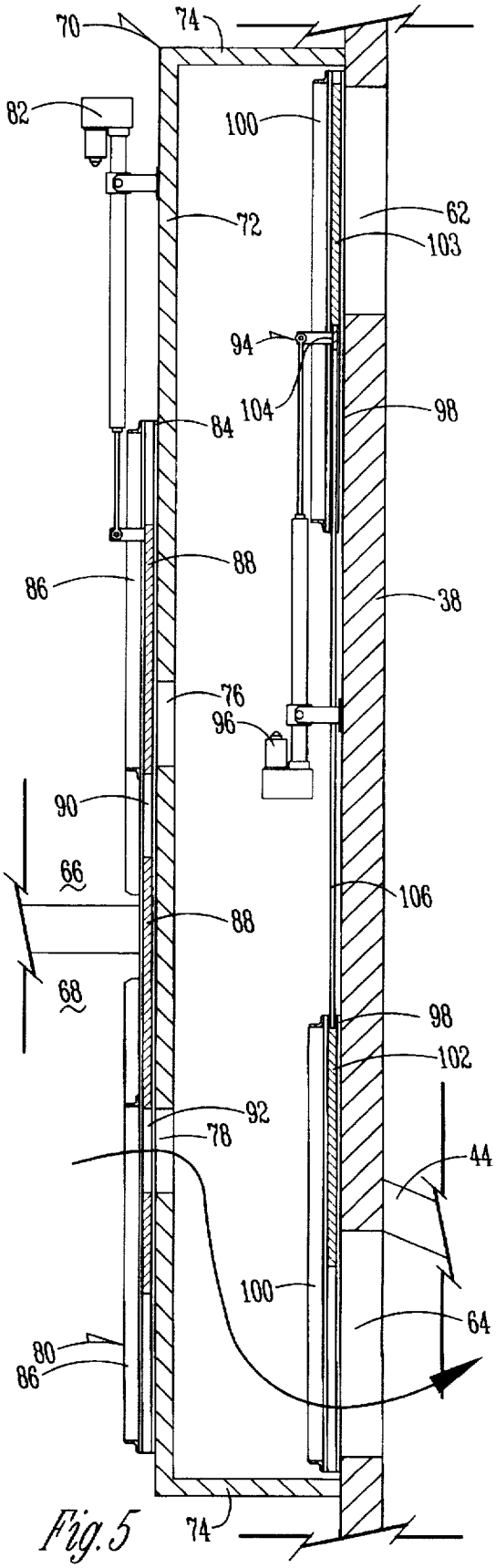

In FIG. 5 the mixing plenum 70 is controlled so that air will flow upward through the corn in the bin 34 and will come entirely from the lower plenum 68. As shown, the slide gate assembly 80 is controlled such that the lower hole 92 formed in the sheet 88 is aligned with the lower plenum opening 78 while the upper hole 90 is not aligned with the upper plenum opening 76 allowing air from the lower plenum to enter the mixing plenum 70 but blocking air from the upper plenum from entering the mixing plenum 70. This configuration results in colder air blown upward through the seed in the bin 34.

Figure 6:
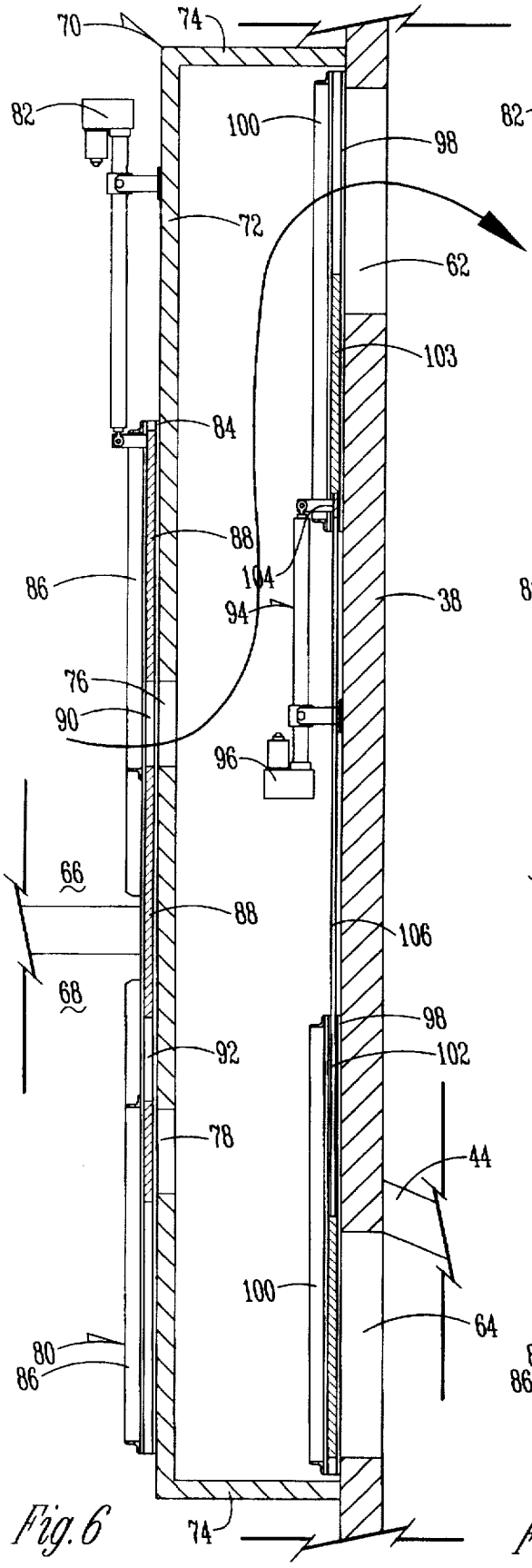

In FIG. 6, the mixing plenum 70 is controlled so that air will flow downward through the corn in the bin 34 and will come entirely from the upper plenum 66. As shown, the slide gate assembly 80 is controlled such that the upper hole 90 formed in the sheet 88 is aligned with the upper plenum opening 76 while the lower hole 92 is not aligned with the lower plenum opening 78 allowing air from the upper plenum to enter the mixing plenum 70 but blocking air from the lower plenum 68 from entering the mixing plenum 70. This configuration results in hot air blown downward through the seed in the bin 34.

Figure 7:
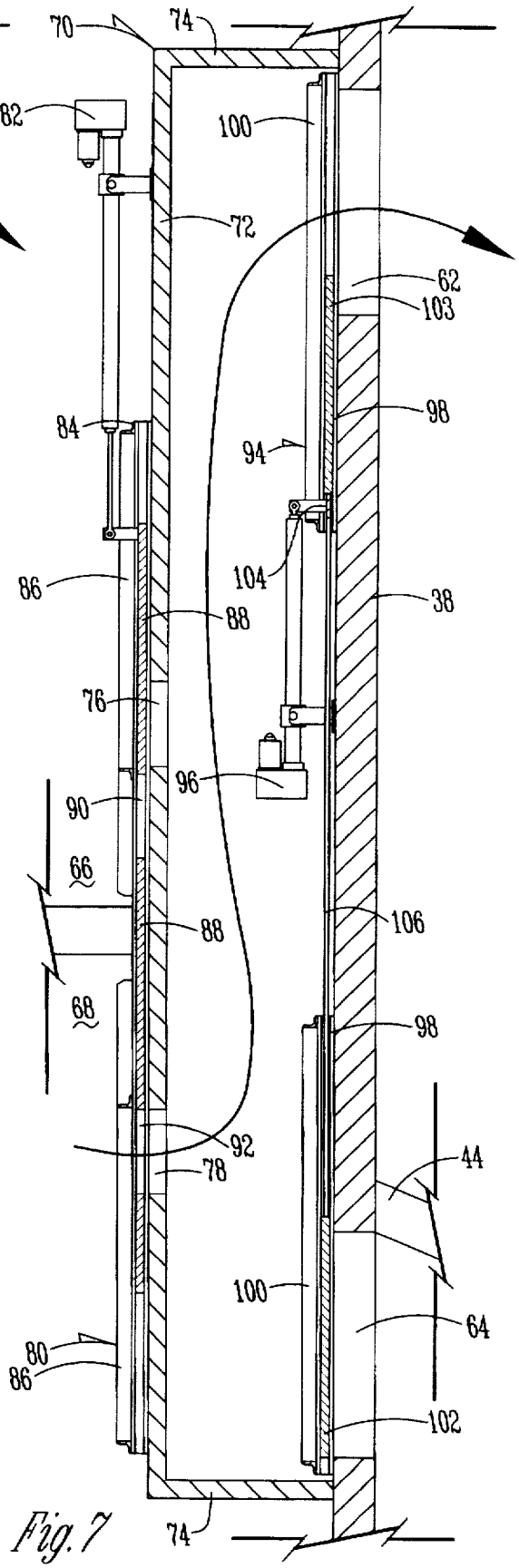

In FIG. 7, the mixing plenum 70 is controlled so that air will flow downward through the corn in the bin 34 and will come entirely from the lower plenum 68. As shown, the slide gate assembly 80 is controlled such that the lower hole 92 formed in the sheet 88 is aligned with the upper plenum opening 76 while the upper hole 90 is not aligned with the lower plenum opening 78 allowing air from the lower plenum to enter the mixing plenum 70 but blocking air from the upper plenum from entering the mixing plenum 70. This configuration results in colder air blown downward through the seed in the bin 34.

Figure 8:
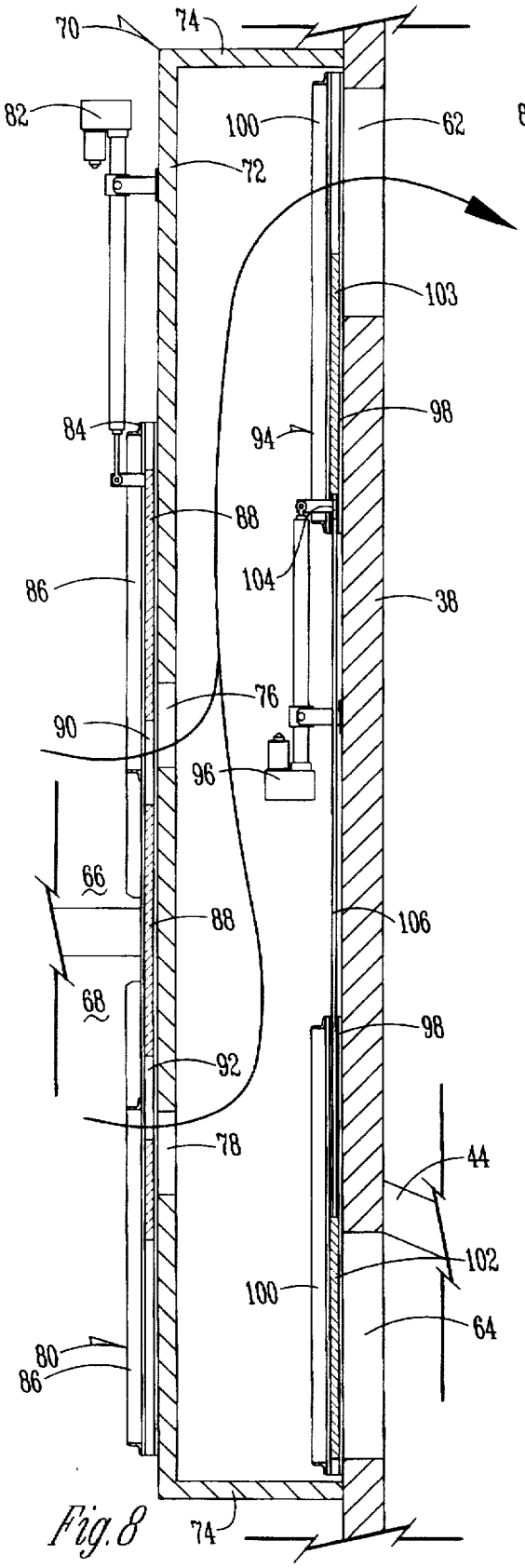

In FIG. 8, the mixing plenum 70 is controlled so that air will flow downward through the corn in the bin 34 and will come from a mixture of air from the upper and lower plenums 66 and 68. As shown, the slide gate assembly 80 is controlled such that the upper and lower holes 90 and 92 formed in the sheet 88 are partially aligned with the upper and lower plenum openings 76 and 78 allowing a mixture of air from the upper and lower plenums to enter the mixing plenum 70. This configuration results in a mixture of air blown downward through the seed in the bin 34. The temperature of the air can be precisely controlled by moving the sheet 88 in either direction. By moving the sheet 88 in either direction, more air from one plenum and less from the other plenum is let in, increasing or decreasing the temperature of the air mixture.

Figure 9:
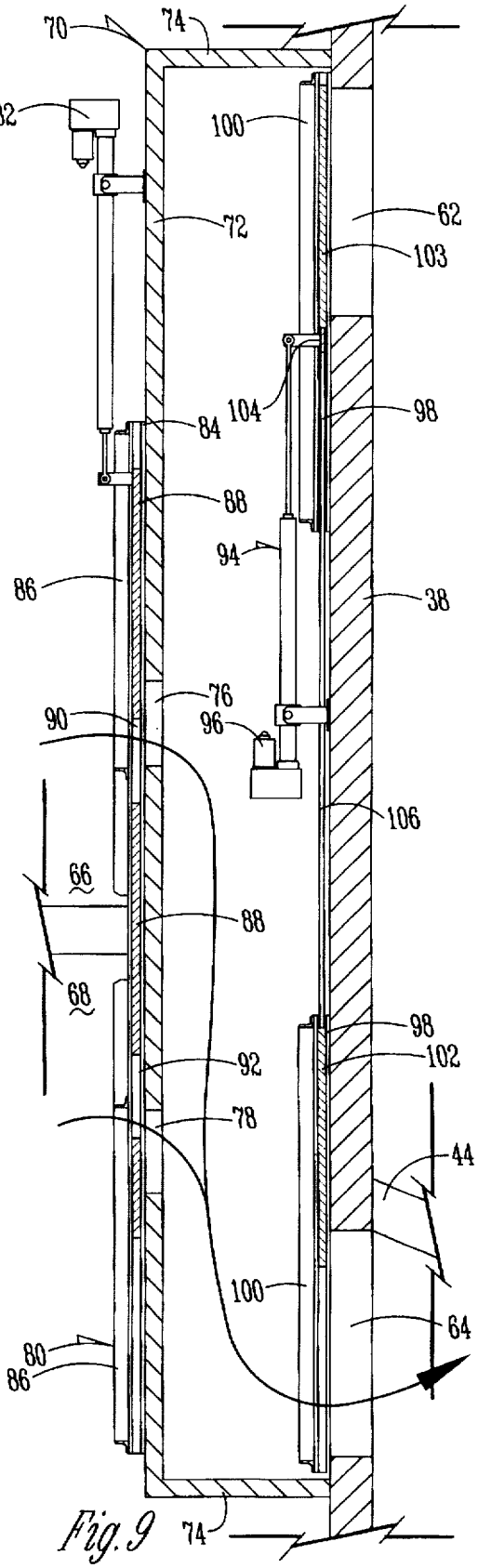

In FIG. 9, the mixing plenum 70 is controlled so that air will flow upward through the corn in the bin 34 and will come from a mixture of air from the upper and lower plenums 66 and 68. As shown, the slide gate assembly 80 is controlled such that the upper and lower holes 90 and 92 formed in the sheet 88 are partially aligned with the upper and lower plenum openings 76 and 78 allowing a mixture of air from the upper and lower plenums to enter the mixing plenum 70. This configuration results in a mixture of air blown upward through the seed in the bin 34. Again, the temperature of the air can be precisely controlled by moving the sheet 88 in either direction. The slide gate assemblies can also shut off the flow of air into the bins 32 and 34 if desired.

Figure 10:
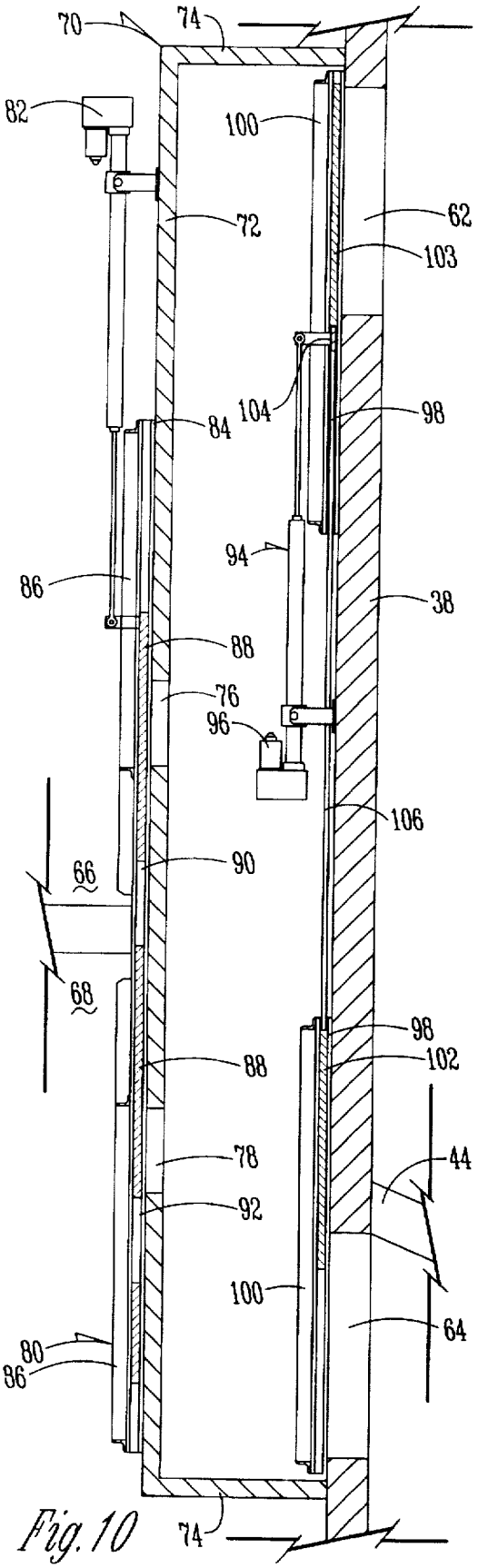

In FIG. 10, the mixing plenum 70 is controlled so that no air will flow through the corn in the bin 34. As shown, the slide gate assembly 80 is controlled such that neither hole 90 and 92 are aligned with the openings 76 and 78, preventing air entering the mixing plenum 70.

Figure 11:
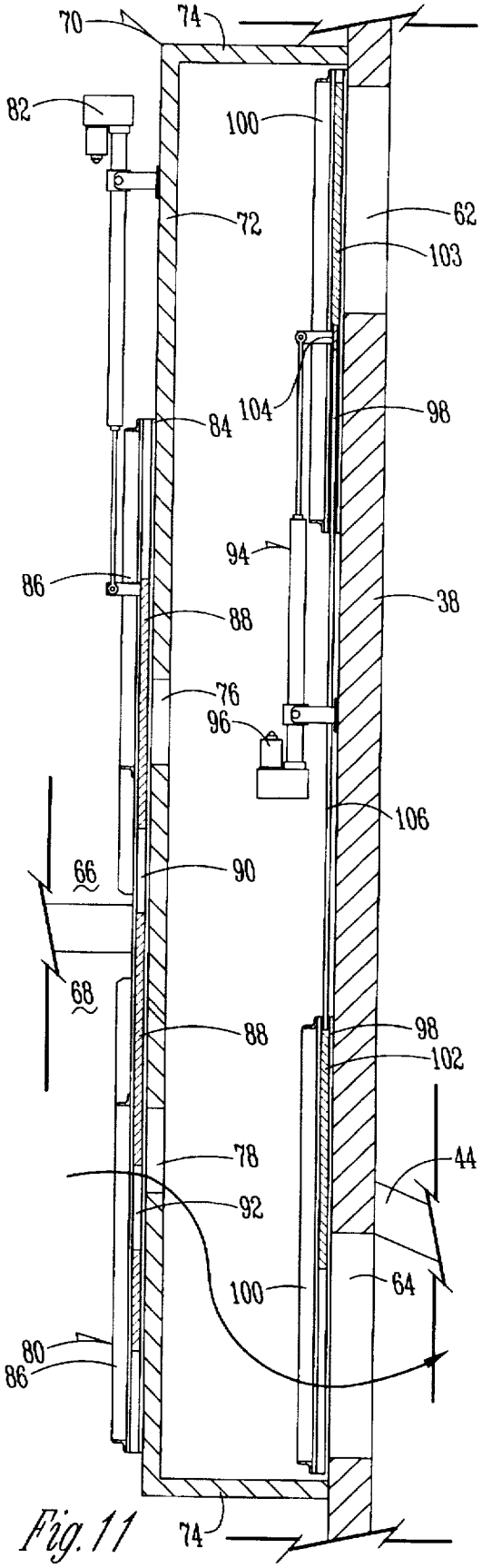

In FIG. 11, the mixing plenum 70 is controlled so that air will flow upward through the corn in the bin 34 and will come entirely from the lower plenum 68, although the air is restricted. As shown, the slide gate assembly 80 is controlled such that the lower hole 92 formed in the sheet 88 is only partially aligned with the opening 78 while the upper hole 90 is not aligned with the opening 76 allowing a smaller amount of air from the lower plenum to enter the mixing plenum 70 while blocking air from the upper plenum from entering the mixing plenum 70. This configuration is used for controlling the drying rate of high moisture seed when even the lowest air temperature is too high to achieve the desired drying rate.

Figure 13:
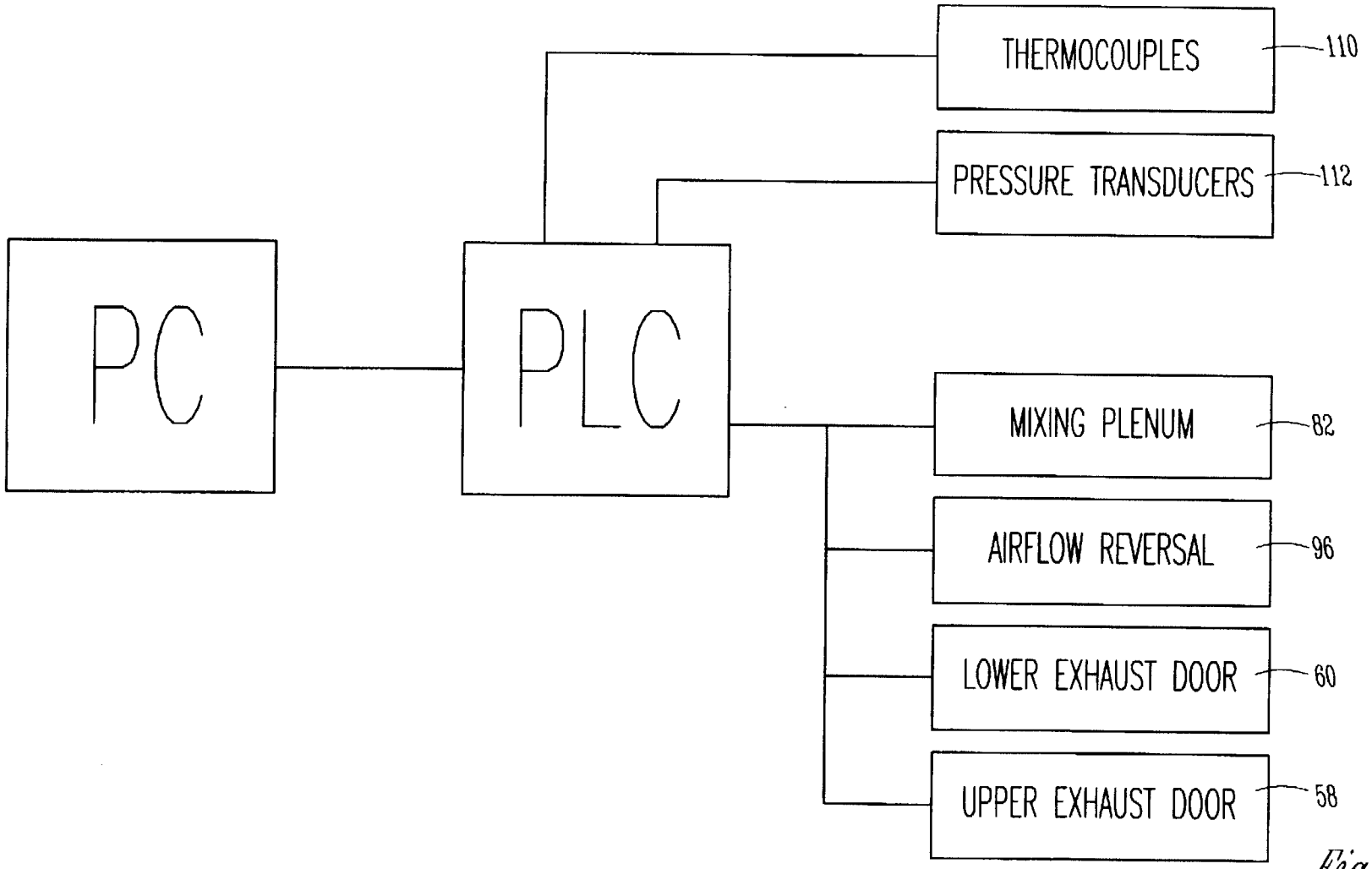
FIG. 13 is a block diagram of the control system of the present invention.

FIG. 13 shows a block diagram of the control system of the present invention. The dryer 30 of the present invention can be controlled in a number of ways based on various information. All of the linear actuators shown in the drawings are preferably controlled by a programmable logic controller. By controlling the actuators, the air flow direction, rate, and temperature can be precisely controlled. The temperature and air flow direction are set depending on information including the temperature within the bin 34 and the air pressure above and below the seed within the bin 34. As shown in FIGS. 2 and 2A, within each bin are a pair of thermocouples 110A and 110B which sense the temperature above and below the seed within the bin. Also shown is a pressure transducer which has inputs 112A and 112B disposed above and below the seed within the bin to determine the differential pressure above and below the seed. The inputs 112A and 112B are operatively connected to the pressure transducer by an air tube. The pressure difference is adjusted based on the filling depth and moisture of the seed within the bin. Ideally, a static pressure drop of two inches is desired. The programmable logic controller is electrically connected to a personal computer (PC) which receives input such as initial seed moisture levels, filling depth, the hybrid of seed, etc. and provides historical graphs showing temperatures, static pressures, seed moistures, etc. Other inputs could include the rate at which the seed in the bin is drying. The PC could be comprised of a single or two independent personal computers. The PC preferably uses a standard graphical user interface (GUI) to input initial seed moisture, filling depth, and the hybrid seed to be dried, etc. The PLC also receives inputs from the thermocouples 110A and 110B as well as the pressure transducer. The programmable logic controller in turn controls the operation of the actuators 82 (to control the mixture of air), 96 (to control the direction of air flow from the mixing plenum 70), 60 to control the operation of the lower exhaust door 54), and 58 (to control the operation of the upper exhaust door 52).

The present invention operates as follows. After harvesting seed such as ear corn, the user of the present invention will open the doors 40 to the bins 32 and 34. The seed is loaded into the bins 32 and 34 up to the line 46 shown in FIGS. 2 and 3. Samples of the seed are taken and the moisture is determined. The user can then enter various inputs into the PC (FIG. 13) such as the seed moisture, the filling depth, and the hybrid of the seed. The PLC uses the user inputs from the PC (as well as inputs from the thermo couples 110 and pressure transducer, if used) and controls the drying process accordingly. The PLC will control the slide gate assemblies 80 and 94 as well as the exhaust doors 52 and 54 to control the temperature and direction of air flow through the seed. The temperature of the air can be precisely controlled by controlling the slide gate assembly 80 on the mixing plenum 70 via the mixing plenum actuator 82. The air flow direction can be controlled by the actuator 96 of the slide gate assembly 94. For example, if the air flow direction desired is downward through the seed, the side gate assembly 94 is positioned as shown in FIGS. 6, 7 and 8. If the desired air flow direction is upward through the seed, the slide gate assembly 94 is controlled as shown in FIGS. 4, 5 and 9. Control of the upper and lower exhaust doors 52 and 54 helps to control the air flow direction as well as the static pressure drop across the seed within the bin. The upper and lower exhaust doors are controlled by the actuators 58 and 60, respectively. The air flow direction can be reversed at any time throughout the drying process as can the temperature of the air. In this way, the temperature and air flow direction through the bin can be precisely controlled to achieve an efficient and consistent drying throughout the bin. With prior art two-pass dryers (FIG. 1), the seed in the bottom of the bin dries first resulting in moisture stratification (dryer seed on the bottom). During the second pass air, the moister seed on top will dry faster. In contrast, with the present invention, the airflow direction can be periodically changed (e.g., every 8–12 hours) which causes more uniform drying which preserves the quality of seeds and allows a user to monitor the moisture level of the seed from a single sample of seed.

A number of factors affect the efficiency of a seed dryer. At the beginning of a drying cycle, a lower air temperature in conjunction with a high flow rate is adequate to begin the drying process. Toward the end of the drying process, high temperature air used in conjunction with a low flow rate is adequate to finish the drying process. Accordingly, the operation of the seed dryer can be effectively and efficiently controlled.

The present invention could also include various alternative or optional features. For example, rather than manually measuring the moisture of the seed in the dryers, automatic moisture sensors could be installed in bins 32 and 34 for sensing the amount of moisture during the drying process. The measured moisture would be used by the control system to assist in controlling the drying process. There are also a lot of ways of controlling the dryer 30. The control system of the present invention could use a fuzzy controller to control the drying process. The fuzzy controller includes a fuzzification module transferring input (such as those used by the PLC controller) for numerical to fuzzy values, an inference module using fuzzy values as input to membership functions and fuzzy logic rules, and a defuzziffication module to transform the fuzzy values into numerical output. The fuzzy controller output is the air temperature setpoint and static pressure setpoint. The result can be transmitted to a PID (proportional integral derivative) controller in charge of the slidegates and to a PID controller in charge of the exhaust doors for air flow restriction. The decisions made by the fuzzy logic engine would be based on the inputs and their relative importance, and sets of roles created from past drying experience. In another alternative embodiment, the operation of the various doors are operated manually by means of ropes, cables, cranks, etc. While such an embodiment would functions a lot of the advantages of the present invention would not be realized. The actuators used to open and close the various doors are preferably standard 24 volt linear actuators, but could be replaced with any suitable actuator.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A seed dryer comprising:

a seed bin for holding seeds to be dried;

a first tunnel for supplying a first source of air having a first temperature;

a second tunnel for supplying a second source of air having a second temperature, the first temperature being greater than the second temperature; and a mixing plenum disposed adjacent to the seed bin and being in communication with the first and second sources of air for mixing air from the first and second air sources before the air is exposed to the seeds within the seed bin for supplying a mixture of air having a desired temperature from the first and second sources to the seed bin to dry seeds within the bin.

2. The seed dryer of claim 1 further comprising an electronic controller for controlling the operation of the seed dryer.

3. The seed dryer of claim 2 wherein the electronic controller controls the amount of air from the first and second sources of air in the mixture of air in order to control the temperature of the mixture of air.

4. The seed dryer of claim 3 further comprising:

a first gate operatively disposed between the first tunnel and the mixing plenum;

a second gate operatively disposed between the second tunnel and the mixing plenum; and wherein the first and second gates are operatively connected to the controller such that the controller can control the amount of air passing from the first and second tunnels to the mixing plenum.

5. The seed dryer of claim 4 wherein the first and second gates are controlled by at least one actuator.

6. The seed dryer of claim 4 wherein the first and second gates are operatively connected together by a linkage.

7. The seed dryer of claim 2 further comprising a plurality of controllable doors formed on the seed bins wherein the operation of the controllable doors determines the direction of air flow through the seed bin.

8. The seed dryer of claim 7 wherein the electronic controller controls the operation of the plurality of controllable doors.

9. The seed dryer of claim 2 wherein the seed bin further comprises:

a first portion for holding seed to be dried;

a second portion disposed above the first portion;

a third portion disposed below the first portion; and wherein the mixture of air is allowed to flow through the first portion between the second and third portions.

10. The seed dryer of claim 9 further comprising:

a first air supply door formed between the mixing plenum and the second portion of the seed bin;

a second air supply door formed between the mixing plenum and the third portion of the seed bin; and wherein the electronic controller controls the operation of the first and second air supply doors.

11. The seed dryer of claim 10 further comprising:

a first exhaust door formed on the second portion of the seed bin;

a second exhaust door formed on the third portion of the seed bin; and wherein the electronic controller controls the operation of the first and second exhaust doors.

12. The seed dryer of claim 11 wherein the direction of air flow through the first portion of the bin is controlled by selectively opening and closing the first and second air supply doors and the first and second exhaust doors to create a path through the first portion of the bin in a desired direction.

13. The seed bin of claim 11 further comprising a plurality of actuators for controlling the first and second air supply doors and the first and second exhaust doors, wherein the plurality of actuators are controlled by the electronic controller.

14. The seed dryer of claim 2 wherein the electronic controller comprises a programmable logic controller.

15. The seed dryer of claim 2 wherein the electronic controller includes a fuzzy logic controller.

16. The seed dryer of claim 1 further comprising at least one pressure sensor operatively connected to the electronic controller for sensing the air pressure in the seed bin.

17. An automatically controlled seed dryer comprising:

a seed bin for holding seeds to be dried, the seed bin having an upper portion disposed above the seeds to be dried and a lower portion disposed below the seeds to be dried;

a first tunnel for supplying a first source of air having a first temperature;

a second tunnel for supplying a second source of air having a second temperature, the first temperature being greater than the second temperature;

a mixing plenum disposed adjacent the seed bin for mixing air from the first and second tunnels to provide air having a desired temperature;

an upper path formed between the mixing plenum and the upper portion of the bin to supply the mixed air to the upper portion of the bin;

a lower path formed between the mixing plenum and the lower portion of the bin to supply mixed air to the lower portion of the bin; and upper and lower exhaust ports formed in the upper and lower portions of the seed bin, respectively, for allowing the mixed air to exit through at least one of the upper and lower exhaust ports, wherein the direction of air flow through the bin is controllable by selectively opening and closing the upper and lower paths and the upper and lower exhaust ports.

18. The automatically controlled seed dryer of claim 17 further comprising:

a first adjustable opening formed between the mixing plenum and the first tunnel for supplying a varying amount of air from the first source of air to the mixing plenum; and a second adjustable opening formed between the mixing plenum and the second tunnel for supplying a varying amount of air from the second source of air to the mixing plenum.

19. The automatically controlled seed dryer of claim 18 further comprising at least one actuator for controlling the first and second adjustable openings.

20. The automatically controlled seed dryer of claim 19 further comprising an electronic controller for controlling the operation of the first and second adjustable openings.

21. The automatically controlled seed dryer of claim 17 further comprising an electronic controller for controlling the operation of the seed dryer.

22. The automatically controlled seed dryer of claim 21 further comprising a plurality of actuators for controlling the opening and closing of the upper path, lower path, and upper and lower exhaust ports.

23. The automatically controlled seed dryer of claim 22 wherein the electronic controller is operatively connected to the plurality of actuators such that the controller controls the plurality of actuators in order to control the direction of air flow through the seed bin.

24. The automatically controlled seed dryer of claim 21 further comprising at least one temperature sensor disposed in the seed bin and operatively connected to the electronic controller for sensing the temperature in the seed bin.

25. The automatically controlled seed dryer of claim 20 wherein the electronic controller comprises a programmable logic controller.

26. A method of drying seeds in a bin comprising the steps of:

providing a bin having an upper portion disposed above the seeds to be dried a lower portion disposed below the seeds to be dried, and upper and lower exhaust ports formed in the bin in the upper and lower portions, respectively;

providing a first source of air having a first temperature;

providing a second source of air having a second temperature;

mixing air taken from the first and second sources of air to provide air having a desired temperature;

blowing the mixed air into the bin and through the seeds;

mixing air taken from the first and second sources of air before the air has been exposed to the seed within the bin; and controlling the direction of air flowing through the seeds by selectively blowing the mixed air into either of the upper and lower portions of the bin and by selectively opening and closing the upper and lower exhaust ports.

27. An automatically controlled seed dryer comprising:

a seed bin for holding seeds to be dried, the seed bin having an upper portion disposed above the seeds to be dried and a lower portion disposed below the seeds to be dried;

a first tunnel for supplying a first source of air having a first temperature;

a second tunnel for supplying a second source of air having a second temperature, the first temperature being greater than the second temperature;

a mixing plenum disposed adjacent the seed bin for mixing air from the first and second tunnels to provide air having a desired temperature;

an upper path formed between the mixing plenum and the upper portion of the bin to supply the mixed air to the upper portion of the bin;

a lower path formed between the mixing plenum and the lower portion of the bin to supply mixed air to the upper portion of the bin; and upper and lower exhaust ports formed in the bin proximate the upper and lower portions, respectively, for allowing the mixed air to exit through at least one of the upper and lower exhaust ports, wherein the direction of air flow through the bin is controllable by selectively opening and closing the upper and lower paths and the upper and lower exhaust ports;

an electronic controller for controlling the operation of the seed dryer; and at least one pressure sensor operatively connected to the electronic controller and disposed within the seed bin for sensing the air pressure in the seed bin.

28. A seed dryer comprising:

a seed bin for holding seeds to be dried;

a source of air having a desired temperature for supplying air to the seed bin to dry seeds within the bin;

a controller for controlling the operation of the seed dryer; and a first pressure sensor disposed in a first location in the seed bin and electrically connected to the controller for sensing the air pressure at the first location in the bin.

29. The seed dryer of claim 28 further comprising a second pressure sensor disposed in a second location in the seed bin and electrically connected to the controller for sensing the air pressure at the second location in the bin.

30. The seed dryer of claim 29 wherein the controller controls the seed dryer based on a determined pressure drop between the first and second locations in the seed bin.

* * * * *